United States Patent [19]

Billing et al.

[11] 4,069,075

[45] Jan. 17, 1978

[54] STRUCTURAL SUPPORT FOR CHAR DERIVED FROM INTUMESCENT COATINGS

[75] Inventors: Rudolph W. Billing, Littleton; George K. Castle, Chelmsford, both of Mass.

[73] Assignee: Avco Corporation, Wilmington, Mass.

[21] Appl. No.: 544,168

[22] Filed: Jan. 27, 1975

Related U.S. Application Data

[63] Continuation-in-part of Ser. No. 478,844, June 13, 1974, Pat. No. 3,913,290.

[51] Int. Cl.[2] ..... B29C 25/00

[52] U.S. Cl. ..... 156/82; 156/71; 427/373; 428/247; 428/256; 428/313; 428/457; 428/920; 428/921

[58] Field of Search ..... 161/89, 93, 94, 95, 161/213, 403, DIG. 4; 52/446, 454, 622; 117/71 R; 156/82, 71; 428/255, 256, 920, 921, 457, 313, 247; 427/244, 373

[56] References Cited

U.S. PATENT DOCUMENTS

| | | | |
|---|---|---|---|
| 2,836,529 | 5/1958 | Morris | 161/95 |
| 2,933,917 | 4/1960 | Sampson | 52/454 |
| 3,320,087 | 5/1967 | Erichson | 161/403 |
| 3,364,097 | 1/1968 | Dunnington | 161/403 |
| 3,543,460 | 12/1970 | Stastny et al. | 161/403 |
| 3,591,437 | 7/1971 | Schafer | 161/403 |

FOREIGN PATENT DOCUMENTS

| | | | |
|---|---|---|---|
| 1,084,503 | 9/1967 | United Kingdom | 428/921 |

*Primary Examiner*—James J. Bell
*Attorney, Agent, or Firm*—Abraham Ogman

[57] ABSTRACT

Intumescent coatings protect structural members from exceedingly high temperatures during fires. Most intumescents, in their virgin condition, can be made to bond tenaciously to the substrate surface it is to protect. When activated by a fire, intumescent materials swell and undergo chemical degradation, and in the process a char is produced. The char insulates the substrate from the heat flux (fire). A reticulated structure is provided to anchor the char to the substrate.

2 Claims, 4 Drawing Figures

STRUCTURAL SUPPORT FOR CHAR DERIVED FROM INTUMESCENT COATINGS

This application is a continuation-in-part of our copending U.S. patent application Ser. No. 478,844 filed June 13, 1974 now U.S. Pat. No. 3,913,290.

BACKGROUND OF THE INVENTION

This invention relates generally to fire protective coatings and more particularly to a wire mesh and fireproof coating to provide a fire insulation reinforcement for structural members.

Structural members, such as steel beams, walls, containers and the like, are often fireproofed with coatings to protect against the heat produced in an unplanned fire. Without this protection, the member would soon reach temperature levels where the accompanying loss in strength will result in the structural member failing under load. Most construction structural members have flange edges such as "I" beams, "H" beams, channels and angles. These edges are the most difficult parts of the member to protect against heating because the flow of heat from the fire comes in three directions (top, bottom, and perpendicular to the edge) instead of the two directions possible on flat planar surfaces.

Some thin coatings presently used for fire protection are intumescent in nature. These coatings swell into a carbonaceous foam when heated which insulates against the fire. However, during fires these materials may lose their bonding properties and sections of the material may fall from the member thereby exposing the bare member to the fire.

The foregoing problem arises from the charactaristic properties of intumescent materials. When activated by a fire, the materials undergo chemical reaction degradation and swells. The residue is basically a foam-like carbon char.

In most cases the intumescent materials include inorganic matter to strengthen the char. However, this has generally proven to be inadequate to maintain the physical integrity of the char in many cases.

For the purpose of this discussion, the term "intumescent char" will be used to identify the char structure that constitutes the mostly carbonaceous residue after the intumescent material is activated and fully reacted by a fire.

Accordingly, it is an object of this invention to provide a structural support for a char derived from an intumescent coating which;

i. acts as an anchor to prevent pieces of the char from breaking away from a substrate;

ii. impedes the propagation of cracks that may occur in an intumescent char;

iii. is in the form of a reticulated wire structure which is embedded within a char-producing intumescent coating;

iv. is a wire mesh embedded within a char-producing intumescent coating; and v. may be used to protect edges of structural members.

This invention provides a structural support for the char residue derived from a char forming intumescent coating on a structural member. The structural support includes a fire resistent mesh member attached to the structural member. A char forming intumescent coating is applied to the structural member so as to substantially encapsulate the entire mesh member so that the char residue, when formed, encapsulates the mesh member and is anchored to the structural member thereby.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

Figure 1:
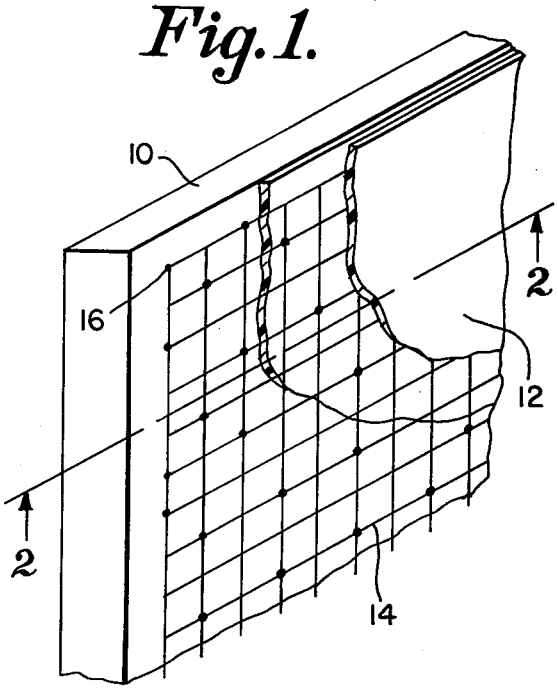
FIG. 1 is a fragmentary perspective of a flat surface, such as a wall, having the structural support of this invention secured thereto.

Referring to FIG. 1 of the drawing, there is shown a fragmentary view of a wall 10 that is protected by a structural support comprising a char-forming intumescent coating 12 and a mesh member 14. The surface may be the edge of a flange of a beam, angle, plates, stiffeners, etc.

Preferably, the mesh member 14 is a wire mesh or a mesh formed from another fire resistent material such as high temperature glass. The wire mesh 14 is mechanically attached to the wall by any suitable means. As an example, if the wall 10 is a steel plate, the wire mesh 14 may be secured thereto by spot welds 16. If the wall will not support a weld, suitable means such as support pins or the like, may be used to support the wire mesh in place.

Friction may be used particularly on edges of structural members.

The char-forming intumescent coating 12 is applied over the wire mesh 14 such that the wire mesh is in effect encapsulated or encased in the intumescent coating 12.

The intumescent coating 12 may take on many of the forms commercially available. For purposes of illustration, the intumescent coating 12 may be the materials sold by Avco Corporation under the trademarks CHARTEK 59 and FLAMAREST 1400 or FLAMAREST 1600. The CHARTEK 59 material, in particular, is formed into a coating by spray application on a suitably prepared substrate such as the wall 10.

It must be emphasized that the wire mesh is not intended to reinforce the virgin intumescent coating 12 or to secure the virgin intumescent coating 12 to the wall 10. In general, a highly tenacious bond may be formed by the wall 10 and the intumescent coating 12 by properly preparing the wall 10 such as by sand-blasting and the use of a suitable primer such as M.L-D 52192-B in the case of a CHARTEK 59 intumescent coating.

The purpose of the wire mesh 14 is to provide support by anchoring the char residue produced when the intumescent coating 12 is fully activated and reacted by a fire. If a fire should occur, the intumescent coating 12 will undergo a complex reaction resulting in a char residue which acts to protect and insulate the wall 10 from the fire.

In most cases, the bond holding the intumescent coating 12 to the wall 10 is largely destroyed after the intumescent coating 12 swells and intumesces. When the intumescent coating 12 is fully activated and reacted, there is produced a char residue which has two characteristics. The char residue is no longer well bonded to the wall 10 and is generally weak structurally, even when the residue contains reinforcement fillers such as inorganic fibers.

To enhance the protective capabilities of the intumescent coating 12, a mesh 14 is provided which acts as a mechanical anchor for the char residue. The char residue encapsulates the wire mesh. In addition, the wire mesh 14 prevents sections of the char residue from falling off in the event fissures occur in the material and the char residue. In general, if a fissure should develop, the fissure would be stopped in the wire mesh level and would not extend to the structural member such as the wall 10.

Figure 2:
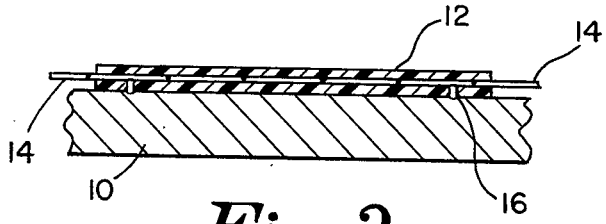
FIG. 2 is a sectional view taken along line 11—11 of FIG. 1.
Figure 3:
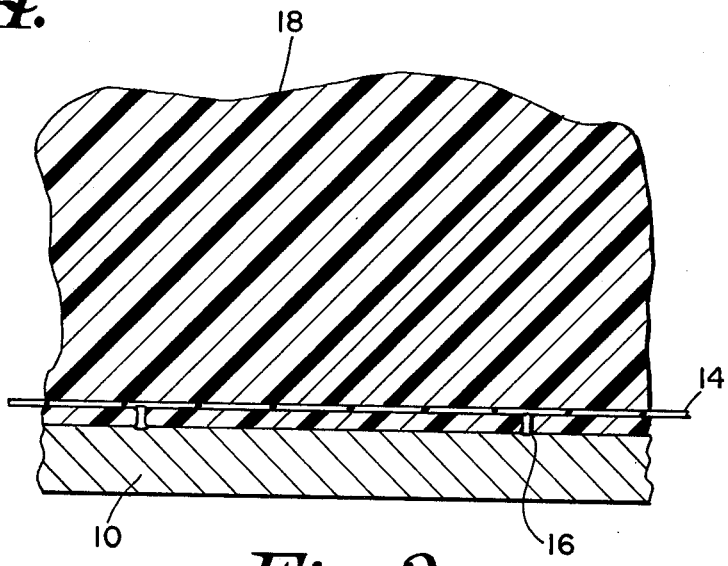
FIG. 3 is the FIG. 1 sectional view after the intumescent coating has been reduced to a char residue.

FIG. 2 depicts the FIG. 1 wall section with an intumescent coating 12 encapsulating a wire mesh 14. FIG. 3 shows the same section after it has been fully activated and reacted by a fire. A char residue 18 is shown encapsulating the wire mesh 14 which, in turn, is anchored to the wall 10 by the weld 16.

It is seen that the structural support of this invention provides added mechanical integrity to the char residue products from a char-forming intumescent material. The structural support of the invention is simple in structure, easily applied, and prolongs the effect of fireproofing of intumescent coatings.

Figure 4:
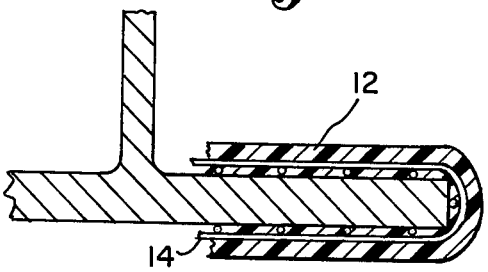
FIG. 4 shows a structural support frictionally attached to an edge of a structural member.

Referring to FIG. 4, there is shown mesh attached by friction to the edge of a structural member. The mesh for supporting the char residue is critical at such edges. For reasons previously pointed out, the stresses on the char residue are extremely high at the edges. The use of a support structure, such as the mesh, with or without insulation, is critical.

In all cases, there is an optimum coating thickness for an allotted protection time. Without the mesh, there is an extremely high probability of fissures and material falling off.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. A method of producing a structural support for the char residue derived from a char-forming intumescent coating on structural members comprising the steps of:

mounting a fire resistant mesh member on the surface of the structural member; and applying a self-adhering char-forming intumescent coating on the surface of the structural member so as to substantially encapsulate the entire mesh member and thereby anchoring to the surface the char residue formed when the intumescent coating is fully activated and reacted by a fire.

2. A method of producing a structural support for the char residue derived from a char-forming intumescent coating on structural members as described in claim 1 where the mesh is a wire mesh.

* * * * *